US006037553A

United States Patent [19]

Stewart et al.

[11] Patent Number: 6,037,553

[45] Date of Patent: Mar. 14, 2000

[54] SLIDE MECHANISM FOR ELECTRICAL AND ELECTRONIC CONTROLS

[75] Inventors: Stephen Stewart, Uniondale; Joseph G. Justiniano, Centereach, both of N.Y.

[73] Assignee: Leviton Manufacturing Co., Inc., Little Neck, N.Y.

[21] Appl. No.: 09/095,823

[22] Filed: Jun. 11, 1998

[51] Int. Cl.[7] ..... H01H 15/02

[52] U.S. Cl. ..... 200/547; 200/329; 200/16 R

[58] Field of Search ..... 200/16 R, 16 B, 200/16 C, 16 D, 16 E, 16 F, 537–552, 308, 293, 296; 116/321, 324

[56] References Cited

U.S. PATENT DOCUMENTS 3,485,204 12/1969 Christman ..... 200/16 R X 4,324,956 4/1982 Sakakino et al. ..... 200/16 R 4,703,712 11/1987 Christman ..... 116/324

*Primary Examiner*—J. R. Scott

*Attorney, Agent, or Firm*—Paul J. Sutton

[57] ABSTRACT

One or two runner wires are added to a sliding-type switch to facilitate movement of the slider with respect to the glide plate and frame. A first set of runner wires is placed in slots in the side walls of the glide plate and are engaged by the slider to provide smooth movement of the slider along the runner wires. A further runner wire engages slots the top of the slider and the inner wall of a frame member about the glide plate and provides additional low friction rails for the slider to move along.

15 Claims, 4 Drawing Sheets

20
22
32
38
42
44
48
52
54
56
58
60
62
64
66
68
70
72
74
76
78
80
82
88

SLIDE MECHANISM FOR ELECTRICAL AND ELECTRONIC CONTROLS

BACKGROUND OF THE INVENTION

1. Field of the Invention

The invention is directed to the field of electrical and electronic switches and more particularly to slide mechanisms for variably controlling electrical and electronic devices such as electronic dimmers, fan speed and motor controllers and the like.

2. Description of the Prior Art

Many prior art slide mechanisms consist of plastic sliders operating on a plastic frame have a poor, uneven feel and are easily affected by dirt and temperature variations which cause the slider to bind. To reduce the binding effects greater tolerance is permitted between the slider and frame which results in looseness and rattle of the slider. A tightening of the tolerance leads to further binding. Further, when a slider is assembled, grease is used to permit the slider to move over the frame more easily. This grease dries or is thinned out and runs making use of the slide mechanism difficult and messy.

Other prior art devices used small touch pads between the slider and frame in an attempt to minimize binding but such small pads are susceptible to wear and have a short life span.

SUMMARY OF THE INVENTION

The instant invention overcomes the difficulties noted above with respect to prior art devices by providing a novel system of runner wires which engage the slider and facilitate its movement with respect to a glide plate and a frame member. The slide mechanism is made up of a frame member, a glide plate, a slider and a slide bar. The glide plate is fastened to the frame member with the slider interposed between them so that by user contact slider can be moved in either of two directions along the glide plate. The slider is held in position by a glide bar which joins two arms of the slider. Slots in each marginal edge of the glide plate receive first runner wires which are locked into place. These first runner wires are engaged by a recess in the slider to facilitate movement of the slider in either of its two directions of travel.

A further runner wire is placed in the frame about the glide plate where it is engaged by the slider and provides a further support for the movement of the slider. It is an object of the instant invention to provide a novel slide mechanism for electrical and electronic controls.

It is an object of the instant invention to provide a novel slide mechanism for electrical and electronic controls which employs a pair of runner wires to improve the movement of a slider with respect to a glide plate and frame member.

It is an object of the instant invention to provide a novel slide mechanism for electrical and electronic controls which employs a pair of runner wires and a further wire to improve the movement of a slider with respect to a glide plate and frame member.

It is another object of the instant invention to provide a novel slide mechanism for electrical and electronic controls that provides a smooth feel throughout its entire range of operation, is free of rattle and looseness, does not require the use of grease during assembly and automatically compensates for wear of parts.

Other objects and features of the invention will be pointed out in the following description and claims and illustrated in the accompanying drawings, which disclose, by way of example, the principles of the inventions, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
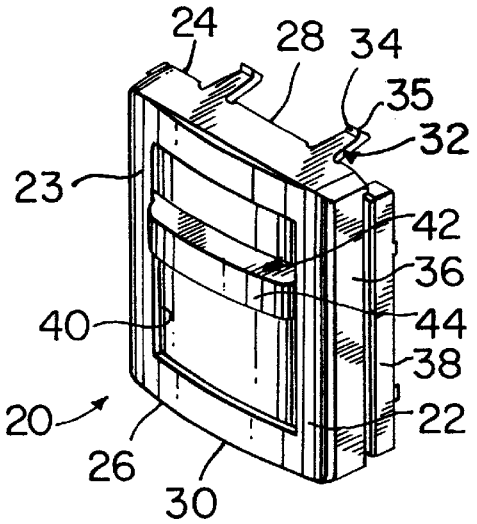
FIG. 1 is a front perspective view of a slide mechanism for electrical and electronic controls constructed according to the concepts of the inventions.
Figure 2:
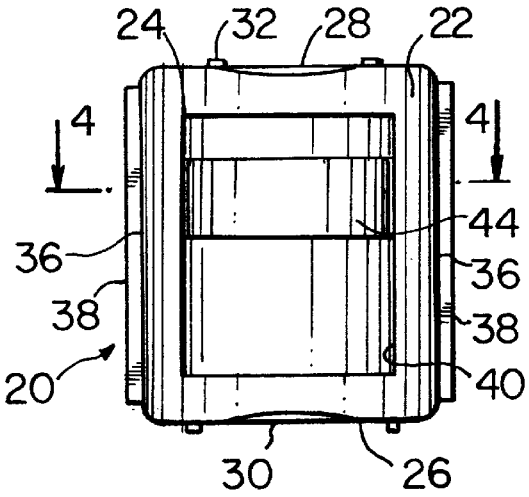
FIG. 2 is a top plan view of the slide mechanism of FIG. 1.
Figure 3:
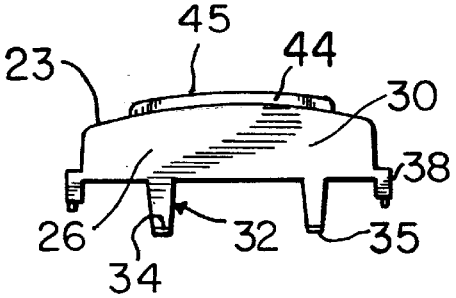
FIG. 3 is a front elevational view of the slide mechanism of FIG. 1.

Turning now to FIGS. 1 TO 13, there is shown a slide mechanism 20 for electronic and electrical controls. Slide mechanism 20 has a frame member 22 (see FIGS. 1, 2 and 3) having a first end 24 and a second end 26. A first end wall 28 is formed at first end 24 and a second end wall 30, generally parallel and spaced apart from said first end wall 28, is formed at second end 26. A pair of locking tabs 32 depend from each of said first and second end walls 28, 30, respectively, each having a locking surface 34 which engages the rear surface of a panel adjacent an aperture therein on which said slide mechanism 20 is placed. Inclined surfaces 35 deflect locking tabs 32 so that they can enter the panel aperture (not shown). At each of the marginal edges is placed a marginal wall 36 joined to the first and second end walls 28, 30, respectively, and to the top wall 23 of the frame member 22 to form a closed box-like structure with an open bottom. Each marginal wall 36 terminates, at its free end, in a rib 38 which engages the top surface of a panel on which the slide mechanism 20 is mounted. Top wall 23 has an aperture 40 therein extending from adjacent the first end wall 28 to adjacent the second end wall 30 and adjacent the marginal walls 36.

A slider 42 (see FIGS. 1 and 9) has a top portion 44 proportioned to fit within aperture 40 of frame member 22 to be contacted by a user to move the slider 42 within the aperture 40 to set variable controls (not shown). Retaining arms 46, one at each end of slider 42 are arranged to ride along a glide plate to be described below. Each of the retaining arms 46 has a first leg 48 and a second leg 50 joined at cross-bar 52 which supports a pair of locking pins 54 used to assemble the slider 42 to a slide bar to be described below. A recess 56 is placed in legs 48, 50, respectively, to receive a further runner wire as set out below. Shoulders 58 are arranged to ride upon runner wires as set out below. The top surface 45 of top portion 44 may be curved as is the bottom surface 47 to conform to the shape of the top surface of a glide plate as set out below.

Figures 4, 5, 6, 7:
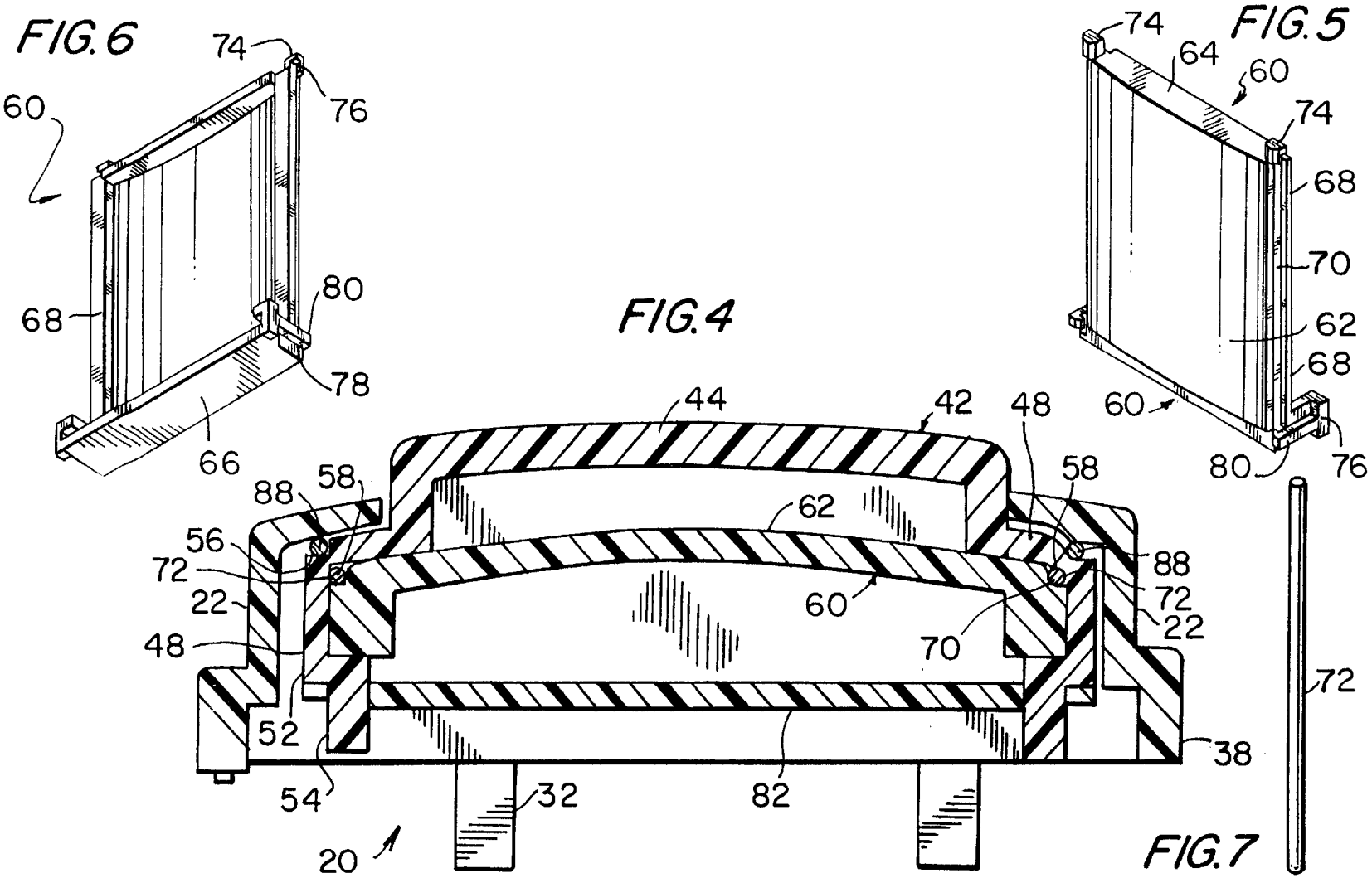
FIG. 4 is a front elevational view, in section, of the slide mechanism of FIG. 1 taken along the lines 4—4 in FIG. 2.
FIG. 5 is a front perspective view of the glide plate of the slide mechanism of FIG. 1.
FIG. 6 is a perspective view of the rear of the glide plate of FIG. 5.
FIG. 7 is a top plan view of a number wire of the slide mechanism of FIG. 1.
Figure 8:
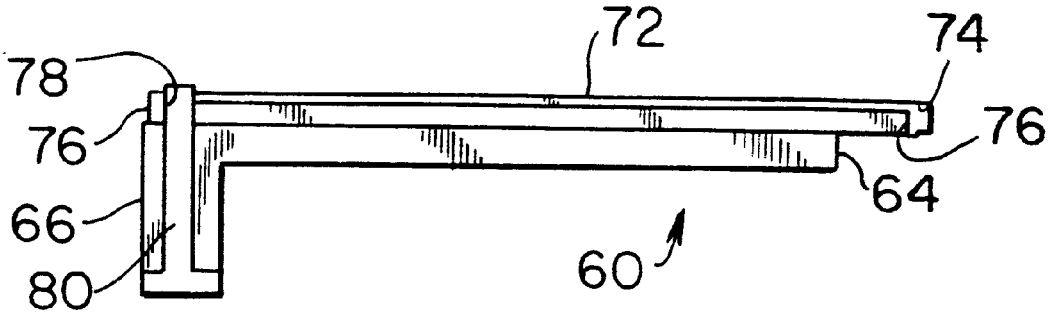
FIG. 8 is a side elevational view of the glide plate of FIG. 5.
Figure 9:
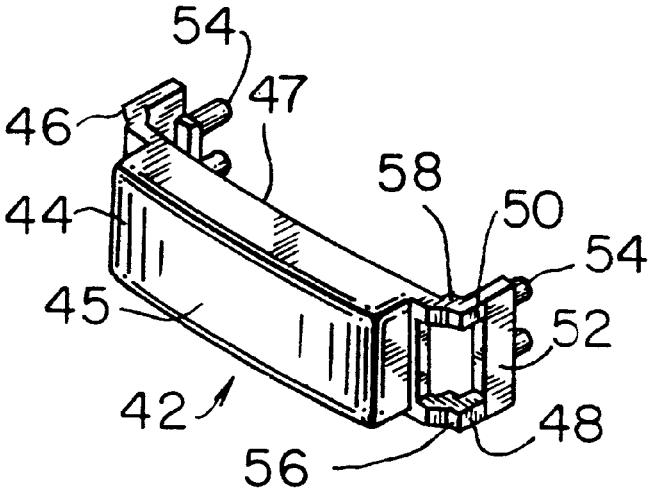
FIG. 9 is a front perspective view of the slider of the slide mechanism of FIG. 1.

A guide plate 60 (see FIGS. 5, 6, and 8) extends under the aperture 40 and beyond to underlie a portion of frame member 22. Glide plate 60 has a top surface 62 which is curved to correspond to the curvature of bottom surface 47 of slider 42. The top surface 62 of glide plate 60 could also be flat and the bottom surface 47 of slider 42 would also be flat to conform to the surface 62 of glide plate 60. The glide plate 60 is fastened to the frame member 22 so as to leave a space between top surface 62 of the glide plate 60 and the adjacent frame member 22 to permit the legs 48, 50, respectively to pass therebetween as the slider 42 is operated. Glide plate 60 has a end wall 64 and a parallel, spaced apart second end wall 66 connected to two marginal edge walls 68. A slot 70 is placed in each of the marginal edge walls 68. These slots 70 will receive a runner wire 72 as shown in FIG. 7. Runner wire 71 may be made of a stiff and resilient metal, such as stainless steel and will be circular in cross-section. Projecting beyond end wall 64 are two retainers 74, each having a recess 76 to receive one end of the runner wires 72. Retainers 74 hold one end of the runner wire 72 in place and flat in the slots 70. Further retainers 76 are formed on end wall 66. These retainers consist of a stop 78 and a movable finger 80. The second end of the runner wire 72 is positioned against stop 78 and finger 80 applies pressure to the runner wire 72 to maintain it in a slot 70.

Figure 10:
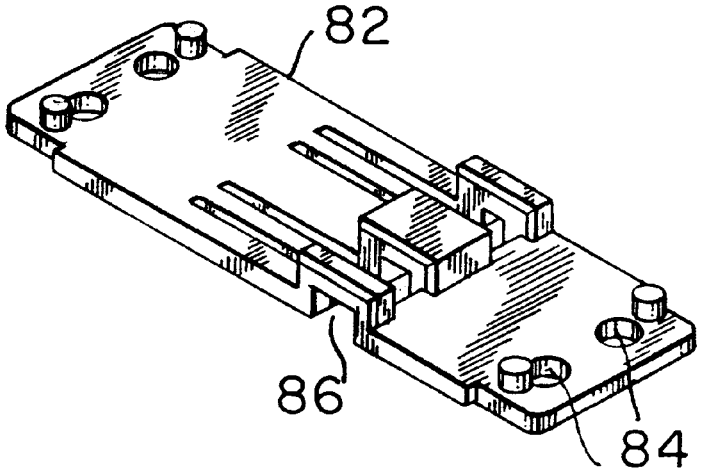
FIG. 10 is a front, top perspective view of the top of the slide bar of the slide mechanism of FIG. 1.
Figure 11:
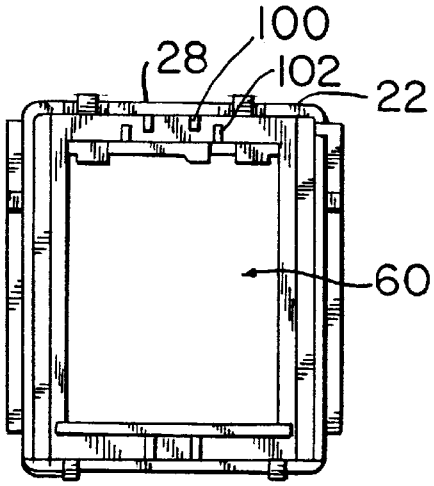
FIG. 11 is a bottom plan view of the glide plate of FIG. 5 installed in a frame member.

Referring to FIG. 10 there is shown a slide bar 82 which is generally rectangular and having two apertures 84 at each end to receive the associated locking pins 54 of the retaining arms 46. The pins 54 can be melted, deformed, glued, sonic welded or otherwise connected to assemble the slide bar 82 to the slider 42. With this arrangement the slide bar 82 moves with slider 42 and prevents removal of slider 42 from about the glide plate 60. A series of receivers 86 are formed in the slide bar 82 to receive the mechanical handles of controls (not shown) to be operated by slide mechanism 20. The frame member 11, the slider 42, the glide plate 60 and the slide bar 82 may be molded or cast from suitable plastic materials such as nylon or the like.

Turning now to FIG. 4 the assembly of the various described components and their cooperations is shown. Runner wires 72 are placed in the slots 70 of the glide plate 60. One end enters recess 76 in retainer 74 which prevents further movement of the runner wire 72 in the direction of retainer 74. The other end of the runner wire engages stop 78 and is retained in such position by the movable finger 80. The finger 80 is outwardly deflected by the wire 72 but once the wire 72 is in the slot 70, finger 80 returns to its initial position due to the resilience of the finger 80 and retains wire 72 in place. The slider 42 is now placed about the glide plate 60 and glide plate 60 is attached to slide bar 82 using the locking pins 54 on glide plate 60 and the apertures 84 in the slide bar 82. The locking pins 54 are heat sealed to the slide bar 82 and slide bar 82 moves along with the slider 42.

The assembled slider 42 and slide bar 82 moves along the runner wires 72 in slots 70 of glide plate 60 which are contacted by shoulders 58 of the slider 42. By this arrangement plastic to plastic friction is eliminated and component wear is greatly reduced. The plastic to runner wire 72 offers uniform feel and travel of the slider 42. The spring characteristics of the runner wires 72 eliminates rattles and looseness associated with prior art plastic slider and frame mechanisms. The arrangement eliminates the need for a lubricant on the slider 42 or glide plate 60. The resilience of the runner wires 72 also compensates for wear of the parts and permits the use of components having greater manufacturing tolerances.

Figure 12:
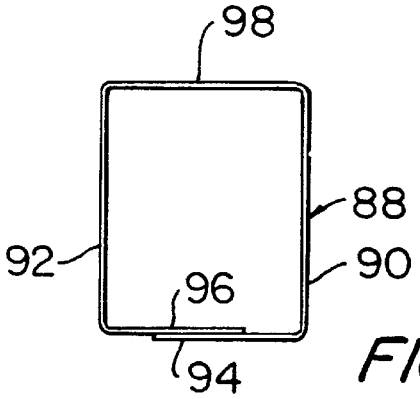
FIG. 12 is a top plan view of a further runner wire which can be employed in the slide mechanism of FIG. 1.
Figure 13:
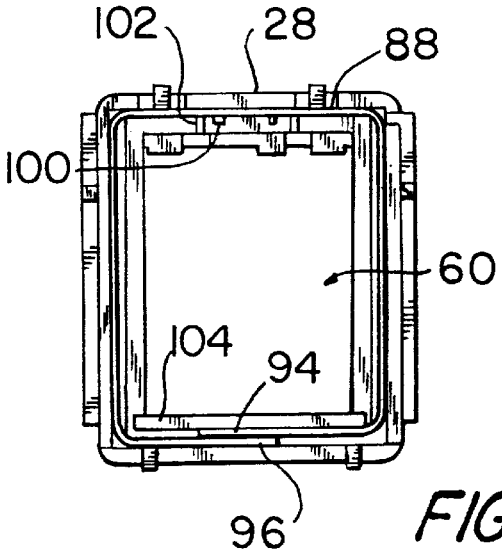
FIG. 13 is a bottom plan view of the glide plate of FIG. 5 and the frame member of the slide mechanism of FIG. 1 with the runner wire of FIG. 12 installed therein.

A further runner wire 88 as shown in FIG. 12 may be added to the slide mechanism 20 to provide additional support for slider 42 and further facilitate the movement of slider 42 with respect to the frame member 22. This further runner wire 88 is also fabricated from a stiff but resilient metal such as stainless steel or the like and is circular in cross-section. Further runner wire 88 is generally rectangular with its ends 94 96, respectively, overlapped but not joined. The runner wire 88 sides 90, 92 fit in the recesses 56 of legs 48, 50 and are held there by the frame member 22. Runner wire 88 provides an additional low friction surface for the slider 42 to move along.

The further runner wire 88 is positioned inside the frame member 58 and about the entire glide plate 60 with the sides 90, 92 in the recesses 56 of the retaining arms 46 of the slider 42. The top portion 98 of the runner wire 88 rests on two ribs 100 on the back surface of the frame member 22 and is held in position against the inside surface of end wall 28 by the two retainer tabs 102 which urge the wire 88 into contact with the inner surface of end wall 28. See FIGS. 11 and 13. The overlapped ends 94, 96 fit between a rib 104 on the back side of frame member 22 and the inside surface of end wall 30. The joinder of the glide plate 60 to the frame member 22 holds further runner wire 88 in place.

While there have been shown and described and pointed out the fundamental novel features of the invention as applied to the preferred embodiments, as are presently contemplated, for carrying them out, it will be understood that various omissions and substitutions and changes of the form and details of the devices illustrated and in their operation may be made by those skilled in the art, without departing from the spirit of the invention.

We claim:

1. A slide mechanism for electrical and electronic controls comprising:

a) a frame member having a top surface and a bottom surface, a first end, a second end and two generally parallel spaced apart marginal edges, said frame member having an aperture therein extending from adjacent said first end to adjacent said second end and adjacent said two marginal edges;

b) a glide plate having a top surface and bottom surface, laced in said frame member with said guide plate top surface adjacent and spaced apart from said frame member bottom surface, said glide plate having a third end, a fourth end and two, generally parallel spaced apart marginal edges, said glide plate, when placed in said frame member, extending over said aperture with said third and fourth ends and said marginal edges of said glide plate extending beyond said aperture;

c) a slider having a top portion and a bottom surface, said bottom surface arranged to be moved by a user along the top surface of said glide plate in directions towards and away from said third end, said slider top portion extending through said aperture to be manipulated by a user;

d) said slider having a retaining arm at each of two marginal edges, each of said retaining arms extending about one of said marginal edges of said glide plate and below a portion of said bottom surface and terminating in locking pins;

e) said glide plate having two slots, one in each of said two marginal edges, adjacent said top surface of said glide plate and two means one for each of said slots to retain a inner wire in each of said two slots;

f) a runner wire positioned in each of said two slots in said glide plate and retained therein by an associated means to retain a runner wire;

g) said slider retaining arms, each engaging a separate one of said runner wires to facilitate movement of said slider along said top surface of said glide plate; and h) a slide bar positioned below said bottom surface of said glide plate and having means to receive said locking pins and fasten said slide bar to said slider, said slide bar moving with said slider.

2. A slide mechanism, as defined in claim 1, wherein said runner wire is fabricated from a stiff metal.

3. A slide mechanism, as defined in claim 2, wherein said runner wire is stainless steel.

4. A slide mechanism, as defined in claim 1, wherein said runner wire is round in cross-section.

5. A slide mechanism, as defined in claim 1, wherein said top surface of said frame member is curved in cross-section.

6. A slide mechanism, as defined in claim 1, wherein said top surface of said glide plate is curved in cross-section.

7. A slide mechanism, as defined in claim 5, wherein said top surface of said glide plate is curved in cross-section.

8. A slide mechanism, as defined in claim 1, further comprising locking tabs extending from each of said first and second ends and below said bottom surface of said frame member to engage a back side of a panel in which said slide mechanism is placed.

9. A slide mechanism, as defined in claim 1, wherein each of said two means to retain a runner wire in each of said two slots comprises: an end stop for engaging a first end of an associated runner wire and preventing movement of said runner wire in a first direction and finger means to prevent movement of said runner wire in a second direction opposite said first direction.

10. A slide mechanism, as defined in claim 1, further comprising:

a) a further runner wire placed in said frame member adjacent said bottom surface and about said glide plate; and b) a recess in each of said retaining arms, each of said recesses receiving a portion of said further runner wire extending parallel with said marginal edges of said glide plate to facilitate the movement of said slider towards and away from said third end.

11. A slide mechanism, as defined in claim 10, wherein said further runner wire is in the shape of a rectangle.

12. A slide mechanism, as defined in claim 10 wherein said further runner wire is fabricated from a single length of wire and ends of said wire are made to overlap.

13. A slide mechanism, as defined in claim 10, wherein said further runner wire is fabricated from a stiff metal.

14. A slide mechanism, as defined in claim 13, wherein said further runner wire is fabricated from stainless steel.

15. A slide mechanism, as defined in claim 10, wherein said runner wire is round in cross-section.

* * * * *